United States Patent [19]

Young et al.

[11] 4,116,555

[45] Sep. 26, 1978

[54] BACKGROUND REMOVAL APPARATUS

[75] Inventors: Eugene F. Young, Henrietta; Curtis M. Ray, Rochester; Ryland F. Rogers, Webster, all of N.Y.

[73] Assignee: Xerox Corporation, Stamford, Conn.

[21] Appl. No.: 764,101

[22] Filed: Jan. 31, 1977

Related U.S. Application Data

[63] Continuation of Ser. No. 626,678, Oct. 29, 1975, abandoned, which is a continuation of Ser. No. 508,954, Sep. 25, 1974, abandoned.

[51] Int. Cl.[2] ..... G03G 21/00

[52] U.S. Cl. ..... 355/15; 15/1.5 R; 118/652; 355/3 DD

[58] Field of Search ..... 355/15, 3 DD; 15/1.5; 222/DIG. 1; 118/652, 658; 427/18

[56] References Cited

U.S. PATENT DOCUMENTS

| | | | |
|---|---|---|---|
| 3,543,720 | 12/1970 | Drexler et al. | 355/3 DD |
| 3,572,923 | 3/1971 | Fisher et al. | 355/15 |
| 3,580,673 | 5/1971 | Yang | 355/15 |
| 3,643,629 | 2/1972 | Kangas et al. | 427/18 X |
| 3,678,895 | 7/1972 | Ohta et al. | 427/18 X |
| 3,713,736 | 1/1973 | Sargis | 355/15 |
| 3,894,513 | 7/1975 | Stanley et al. | 118/652 |
| 3,994,725 | 11/1976 | Volkers | 96/1.4 |

*Primary Examiner*—Richard L. Moses
*Attorney, Agent, or Firm*—Earl T. Reichert

[57] ABSTRACT

An electrically biased magnetic brush is used to remove background toner particles from a photoreceptor, and an electrically biased reclaim roller is used to remove the toner particles from the magnetic brush. Before contacting the photoreceptor once again, the bristles of the magnetic brush are discharged by a charge bar, the bristles having been charged by the biased reclaim roll. A second reclaim roller biased to the opposite polarity of the first may also be used to remove toner particles from the magnetic brush to be certain that toner particles of opposite polarities are removed from the magnetic brush. In addition, if desired, a mixture of two groups of carrier beads may be used to form the bristles of the magnetic brush, the groups having different tribo-electric properties.

6 Claims, 6 Drawing Figures

BACKGROUND REMOVAL APPARATUS

This is a continuation of U.S. application Ser. No. 626,678 filed on Oct. 26, 1975 now abandoned, the latter being a continuation of U.S. application Ser. No. 508,954 filed on Sept. 25, 1974 now abandoned.

BACKGROUND OF THE INVENTION

This invention relates to an improvement in an electrostatic reproduction machine, but more particularly to an electrostatic reproduction machine having an improved apparatus for removing background particles from a photoreceptor prior to image transfer.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface, and then exposed to a light pattern of the image being reproduced to thereby discharge the charge in the areas where light strikes the layer. The undischarged areas of the layer thus form an electrostatic charge pattern or latent electrostatic image in conformity with the configuration of the original pattern.

The latent electrostatic image is developed by contacting it with a finely divided electrostatically attractable material, such as a resinous powder. The powder is held in the image areas by the electrostatic fields on the layer. Where the field is greatest, the greatest amount of material is deposited, and where the field is least, little or no material is deposited. Thus, a powder image is produced in conformity with the image of the original being produced. The powder image is subsequently transferred to a sheet of paper or other transfer member, and suitably affixed thereto to form a permanent copy.

The latest concept for electrostatic reproduction machines utilizes high speed flash exposure of a document, and a moving photoconductive material in the form of an endless belt which is continuously charged. Additionally, such reproduction machines are provided with a developing system which supplies toner particles in relatively large quantities for solid area coverage, such as a magnetic brush developing apparatus. Thus, after the belt passes the magnetic brush assembly, for example, a xerographic powder image is formed on the belt which corresponds to the electrostatic latent image. This powder image is then transferred to a support surface (e.g., a sheet of paper) to which it is fused by a fusing assembly whereby the powder image is caused to adhere to the support surface permanently.

The latest electrostatic reproduction machines are high speed machines which print copies at a rate substantially in excess of any previous electrostatic reproduction machines, and are intended to compete with other types of printing machines, e.g., offset printing machines. Because of this, it is desired that the quality of the copies made, be extremely high. Important to high quality copies is the removal of all or substantially all of the background particles (i.e., toner in non-image areas) from the photoreceptor before transfer of the developed image to a support member. As stated above, large amounts of toner are used in these high speed electrostatic reproduction machines to develop the latent electrostatic image, and to produce high quality copies, a very efficient background removal apparatus is necessary to remove any background particles which may be present after development. This apparatus must be superior to previous means used to reduce the background (e.g., lamps or pre-transfer corona charging devices used to prevent or reduce transfer of background particles) on copies in that it must eliminate all or substantially all of the background from the copies; the apparatus must also not detrimentally affect the developed image on the photoreceptor to any great degree as did some of the previous means.

It is also highly desirable that the life of the developer (carrier plus toner) be extended, and the life of the developer is directly related to background, the less the background, the longer the life of the developer. By efficiently removing all or substantially all of the background, developer life will be substantially increased, possibly doubled. Also, this apparatus should be integrated into a machine so as to occupy minimal space, cooperate with other elements of the machine, be accessible, and be designed for easy maintenance by the machine operator.

SUMMARY OF THE INVENTION

The present invention is directed to background removal apparatus having a magnetic brush for contacting a photoreceptor to remove background toner particles, and at least one reclaim roller located so as both to remove the particles from the magnetic brush roller and discharge them into the main developer sump of the machine, and to serve as a "doctor blade" for the bristles (formed by magnetic carrier beads) of the magnetic brush roller. A grounded or properly biased charge bar is located so as to contact the bristles of the magnetic brush roller after they have been contacted by the reclaim roll, but before they contact the photoreceptor once again; the purpose of the charge bar is to discharge or substantially discharge any charge placed on the magnetic carrier beads as a result of their contact with the reclaim roller. The background removal apparatus has openings for easy loading of carrier beads into and unloading of carrier beads from the apparatus; when the apparatus is unloaded, the carrier beads drop into the main developer sump.

DETAILED DESCRIPTION OF THE INVENTION

Figure 1:
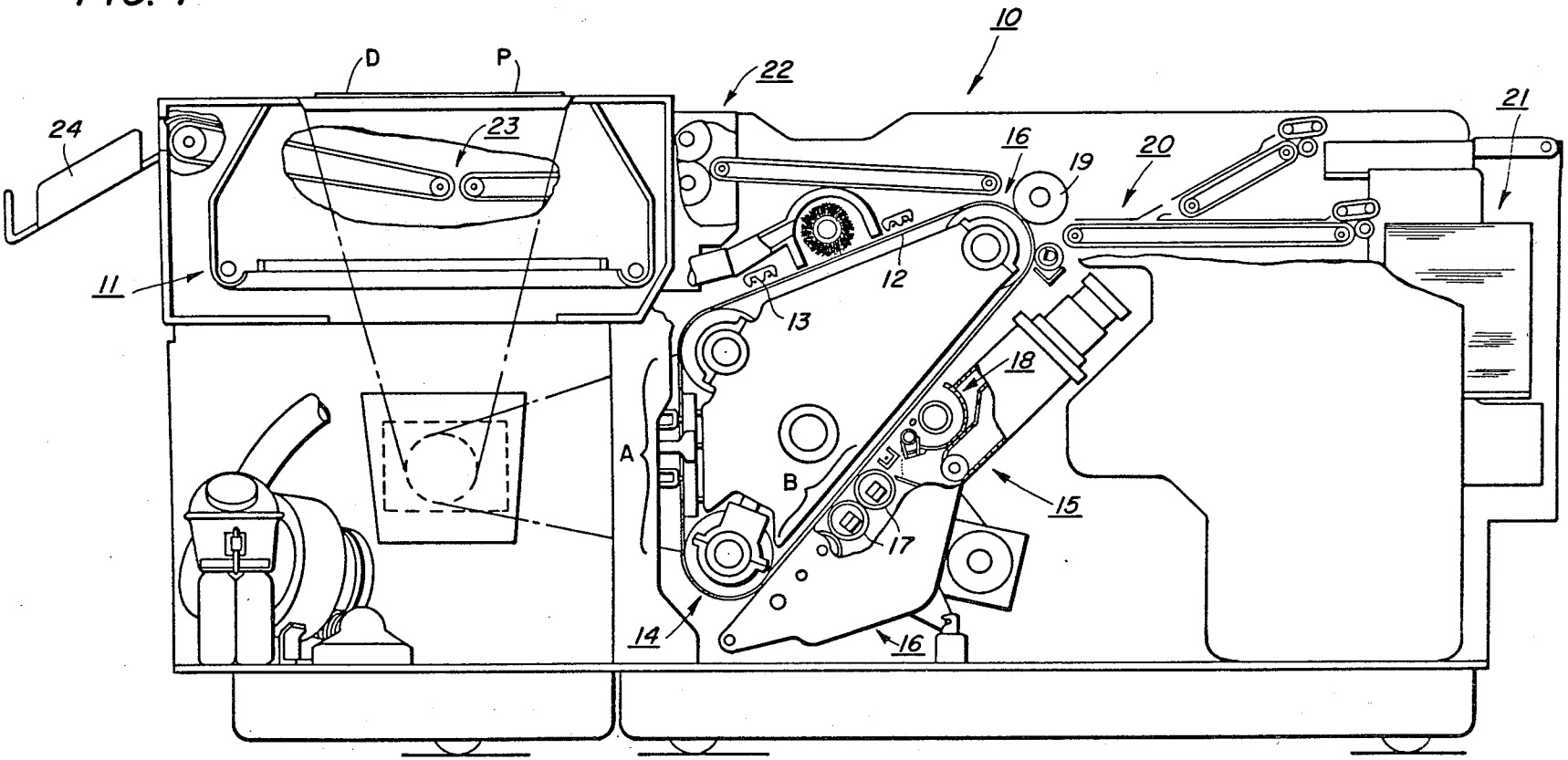
FIG. 1 is a schematic sectional view of an electrostatic reproduction machine embodying the principles of the invention.

For a general understanding of an electrostatic reproduction machine in which the invention may be incorporated, reference is made to FIG. 1 in which the various system components for the machine are schematically illustrated. As in all electrostatic systems of the type illustrated, a light image of a document to be reproduced is projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it may be fused by a fusing device whereby the powder image is caused permanently to adhere to the support surface.

In the illustrated machine 10, an original document D to be copied is placed upon the transparent support platen P fixedly arranged in an illumination assembly generally indicated by the reference numeral 11, arranged at the left end of the machine; a platen cover (not shown) is then lowered onto the original D to cover the same. While upon the platen P, an illumination system flashes light rays upon the original thereby producing image rays corresponding to the informational areas on the original. The image rays are projected by means of an optical system for exposing the photosensitive surface of a xerographic plate or photoreceptor in the form of a flexible photoconductive belt 12. The surface of the belt was made photosensitive by the previous step of uniformly charging the same by means of a corona generating device 13. In order to effect image processing, the belt 12 is arranged on a belt assembly generally indicated by the reference numeral 14.

The photoconductive belt assembly 14 is slideably mounted upon two support shafts, one of which is secured to the frame of the machine, and is adapted to drive a belt 12 in the direction of the arrow at a constant rate. During this movement of the belt, the reflected light image of an original on the platen is flashed upon the surface of the belt to produce electrostatic latent images thereon at an exposure station A.

As the belt surface continues its movement, the electrostatic latent image passes through a developing station B in which there is positioned a developer/background removal assembly generally indicated by the reference numeral 15, and which provides development of the electrostatic latent image by means of a developer 16 having multiple magnetic brush 17. The developed electrostatic image then moves past a background removal apparatus 18 which removes background particles from the belt 12 prior to transfer of the developed image.

The developed electrostatic image (without background particles) is then transported by the belt to a transfer station C where a sheet of copy paper is moved between a transfer roller 19 and the belt at a speed in synchronism with the moving belt in order to effect transfer of the developed image. There is provided at this station a sheet transport mechanism indicated generally at 20 adapted to transport sheets of paper from a paper handling mechanism generally indicated by the reference numeral 21 to the developed image on the belt at the station C.

After the developed image is transferred to the sheet, the latter is stripped from the belt 12 and conveyed into a fuser assembly indicated generally by the reference numeral 22 where the developed and transferred xerographic powder image on the sheet material is permanently affixed thereto. After each copy is thus produced, it is delivered via sheet transport mechanism 23 into an output tray 24.

Additional details regarding the subject electrostatic reproduction machine are set forth in a copending U.S. patent application Ser. No. 312,411 assigned to the same assignee. Although not specifically discussed herein, it is understood that the present invention may also be utilized in other types of electrostatic copying or duplicating machines, and is not limited to the high speed duplicating machine disclosed herein.

Figure 2:
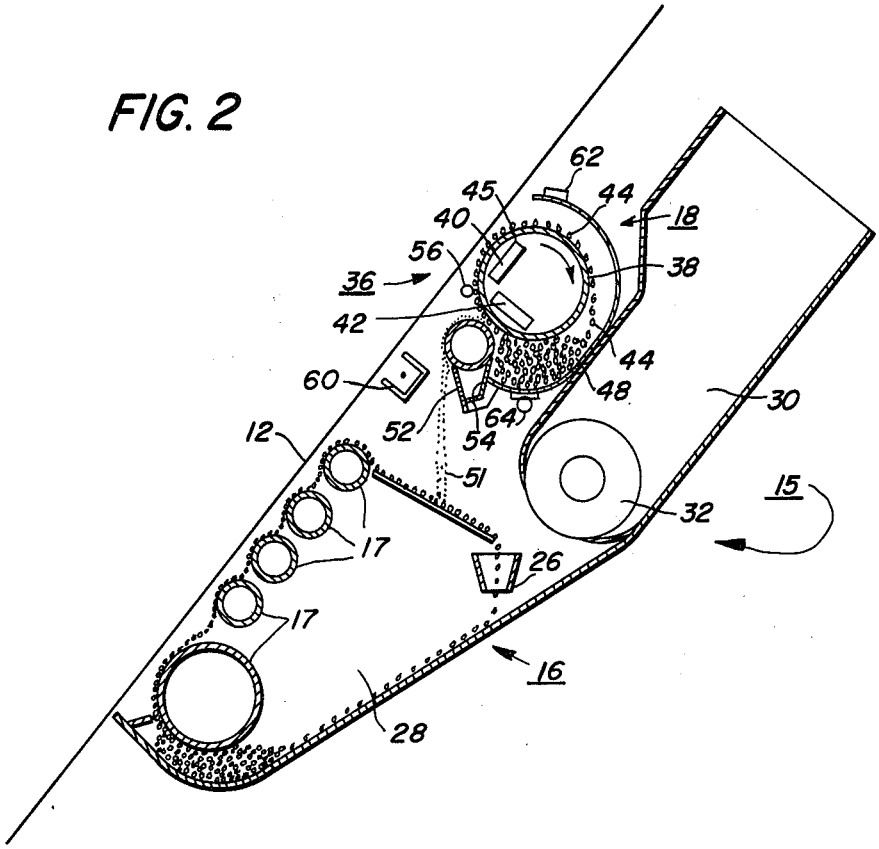
FIG. 2 is an enlarged schematic view showing the developer, the background removal apparatus, and their interrelationship.

Referring to FIG. 2, an enlarged schematic view of an embodiment of the invention is shown. The latent electrostatic image is developed by a plurality of magnetic brushes 17 which move developing material (toner particles and magnetic carrier beads) up an inclined plane as shown. The developing material is then directed through a cross-mixing baffle 26, and returned to the main developer sump 28. Toner is periodically dispensed into the developer sump via a toner dispenser 30 having a porous dispensing roller 32. Further details of the developer 16 are described in U.S. Pat. No. 3,724,422, the disclosure of which is hereby incorporated by reference.

For purposes of illustration only, it is assumed herein that the belt 12 is initially charged to a positive polarity of approximately 900 volts or more by the corona charging device 13. After being exposed to a light pattern of the image being reproduced, the image areas are approximately 700–900 volts, but the background (non-image) areas are discharged or substantially discharged; the background areas may still have a positive charge of approximately 200 volts or less. Magnetic carrier beads or particles which will place a negative charge (via triboelectricity) on the toner particles are used in the developer 16. When the negatively charged toner is used to develop the image, the toner will be strongly attracted to the highly charged positive image areas. Some toner particles, however, may become loosely attached to the weakly charged background areas also.

The belt 12 with the developed image thereon then moves past the background removal apparatus 18 where it is contacted by the bristles of a detoned magnetic brush 36, detoned meaning that the amount of toner is compared to carrier within this apparatus is preferably less than 0.1% by weight. The brush 36 has a rotatably mounted cylinder 38 made out of any suitable non-magnetic material, e.g., brass, aluminum, copper or stainless steel. Arranged within the cylinder 38 are two permanent bar magnets 40 and 42, the magnets having a magnetic strength and being arranged substantially as shown so that the bristles formed by magnetic carrier beads 44 on the periphery of the cylinder 38 are stiff enough to remove substantially all of the background toner particles from the belt 12 without substantially affecting the developed image thereon. It is noted that magnet 40 is arranged so that its corners are not located as close to the belt 12 as is possible. Locating the corner 45 of the magnet 40, for example, as close as possible to the belt 12 would provide the stiffest bristles possible for this particular magnet.

The bristles formed on the cylinder 38 adjacent to the belt 12 are formed by magnetic carrier beads 44 which can be coated or uncoated. It will be appreciated that bristles are formed from the outer surface of cylinder 38 due to the lines of force from magnets 40 and 42 which are oriented in polar paths as indicated by the letters N and S which illustrate north and south poles, respectively. The magnetic beads comprise any suitable material. The magnetic material may be "soft" i.e., retaining very little residual magnetism, or the permanent magnet type. Typical magnetic materials comprise powdered iron including types known commercially as alcoholized iron and carboxal iron, steel, nickel, alloys of magnetic iron, such as nickel-iron alloys, nickel-cobalt-iron alloys, and magnetic oxides, such as, iron oxide, hematite ($Fe_2O_3$) and magnetite ($Fe_3O_4$) and magnetic ferrites. Preferably, the median size of the magnetic carrier beads is approximately 85 to 95 microns with the range of sizes extending from approximately 50 microns to approximately 120 microns. The magnetic beads can be coated with an electrically insulating material. Typical coating materials are described in U.S. Pat. No. 2,618,551 to Walkup, U.S. Pat. No. 2,618,552 to Wise, U.S. Pat. No. Re25,136 to Carlson and U.S. Pat. No. 2,874,063 to Greig. The materials disclosed in these patents as well as many of the magnetic materials mentioned above, also have a triboelectric attraction for the toner particles which serves to further facilitate removal of the toner particles onto the beads.

As the bristles of the brush 36 sweep over the surface of the belt 12, background toner particles are removed by the bristles and adhere thereto. Although in absolute terms much more toner is removed from the image areas than from the background areas of the belt, percentage-wise, a much greater portion of toner is removed from the background area (approximately 80–90%) than from the image areas (approximately 10–20%); the image areas are not detrimentally affected. To assist in removing toner from the belt 12, the magnetic brush 36 is electrically biased to a positive polarity of approximately 150 volts. As the carrier beads leave the magnetic field of magnet 40, they fall freely into the sump 48 of the background removal apparatus. Arranging the magnets substantially as shown allows the carrier beads to fall freely into the sump 48 rather than remain captured all the way around the cylinder 38. This improves mixing and increases the life of the carrier since each carrier bead is used less often, and the impaction rate will consequently be less. Impaction of toner onto the carrier beads shortens the useful cleaning life of the carrier beads.

The carrier beads 44 then enter the magnetic field of the second magnet 42 and are again attracted to the cylinder 38. As the cylinder 38 continues to rotate, the carrier beads 44 pass the reclaim roller 50 which is electrically biased to a positive polarity of approximately 1,150 volts. The reclaim roller 50 serves not only to attract the negatively charged toner particles from the magnetic brush 36, but also serves as a "doctor blade" so as to trim excess carrier beads from the cylinder 38 which then fall back into the sump 48. The reclaim roller 50 rotates in a counter-clockwise direction as shown, and the negative toner particles 51 attracted thereto are removed by a brass scraper blade 52 and dropped into the main sump 28 of the developer housing. An elastomeric lip seal 54 serves to prevent any of the material within the sump 48 from escaping. The reclaim roller 50 may be made of any suitable non-magnetic material, e.g., non-magnetic stainless steel.

Figure 3:
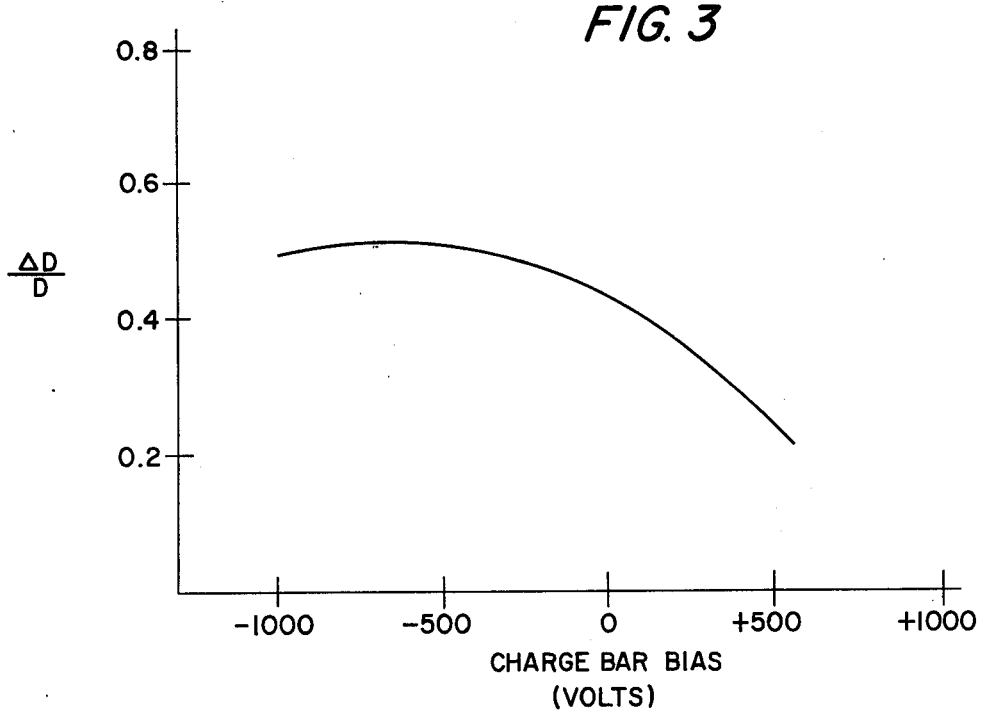
FIG. 3 is a plot of fractional decrease in background density versus charging bar bias.
Figure 4:
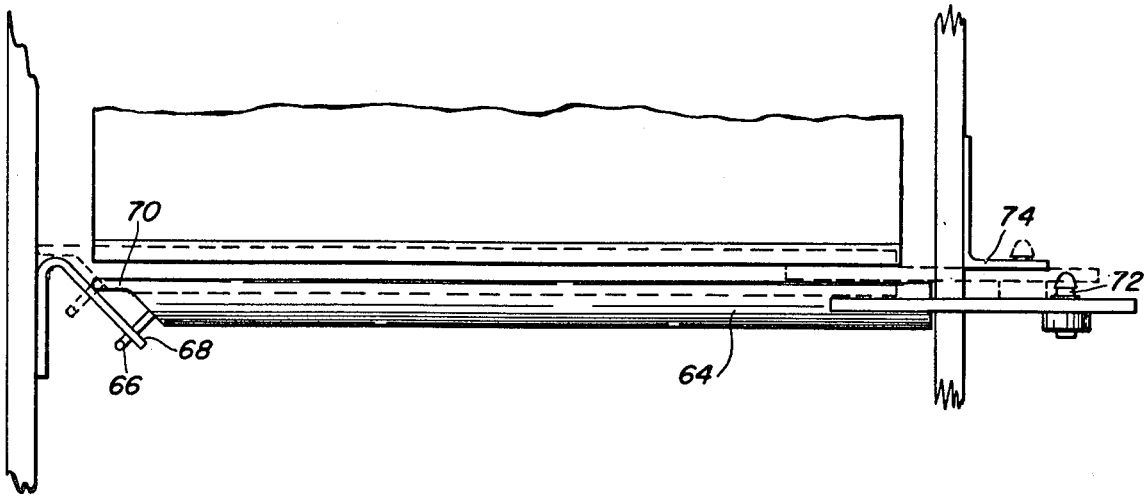
FIGS. 4 and 5 are enlarged views of the background removal apparatus showing the magnetic brush roller, the reclaim roller, and a detailed view of the means for unloading the apparatus.

To discharge any charge placed upon the carrier beads by the electrically biased reclaim roller 50, a conductive charging bar 56 is located between the reclaim roller 50 and the belt 12. The charging bar 56 may also be made of any suitable non-magnetic material, e.g., non-magnetic stainless steel. The charging bar 56 may either be grounded or electrically biased to a polarity opposite that of the reclaim roll. This charging bar serves to discharge the carrier beads prior to the time the carrier beads reach the belt 12. It has been determined that charging bar 56 is necessary for the effective removal of background particles. Referring to FIG. 3, it can be seen that the background removal efficiency changes when the polarity of the charging bar 56 changes from positive to negative.

To make it easier for the magnetic brush 36 to remove background particles, a corona charging device 60 may be incorporated into the sytem as shown in FIG. 2. This corona charging device will place an appropriate charge on the background so that the background particles are more readily removed by the magnetic brush 36.

Figure 5:
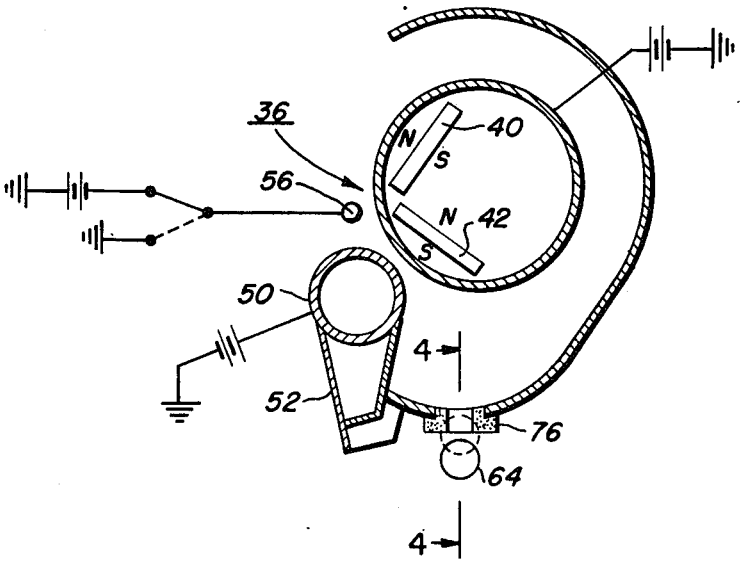

Another novel feature of this invention is the arrangement of the developer 16 and the background removal apparatus 18 into a single integrated unit. When it is desired to load carrier into the background removal apparatus 18, a loading door 62 located above the magnetic brush 36 may be removed and the carrier loaded into the apparatus. This provides for easy maintenance of the apparatus. When the carrier has been spent, and it is desired to remove or unload the same from the sump 48, an unloading door 64 is provided in the bottom of the sump as can be seen more clearly in FIGS. 5 and 6. This unloading door 64 is in the form of a circular rod, one end of the door having a bent rod 66 which rides in a slotted ramp 68. When the door 64 is in its closed position, a lip 70 rests upon the upper end of the slotted ramp 68. The door 64 is held in its closed position by a latch 72 on the other end thereof, the latch 72 being supported by a slot in bracket 74. When the door 64 is so latched, it is held in place against the gasket 76. Thus, it can be seen that the present arrangement provides for easy loading and unloading of the background removal apparatus 18. The overall arrangement is such that a minimum of space is occupied by the developer/-background removal apparatus 15, and a cooperative relationship is provided between the developer 16 and the background removal apparatus 18.

Figure 6:
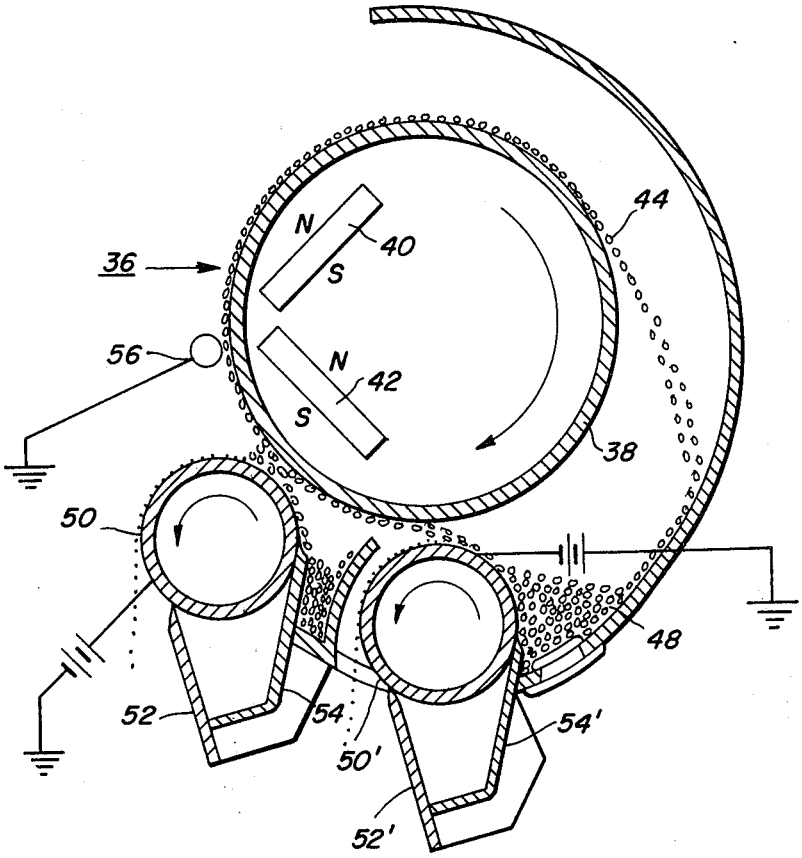
FIG. 6 shows a second embodiment of the invention in which two reclaim rollers are used to remove two species of toner.

It is believed that a portion of the toner particles in the background areas are charged to a positive polarity. To be certain that all toner particles (regardless of polarity) are removed from the sump 48, a second reclaim roller 50' may be added to the system as shown in FIG. 6. Reclaim roller 58 is identical to the first reclaim roller 50 except that it is electrically biased to the opposite polarity and magnitude of reclaim roller 50 so as to remove any toner particles which are charged to a positive polarity.

As stated above, various types of coating material may be used on the carrier beads used in the background removal apparatus 18. A coating may be used which will place a positive charge on toner particles when contacted by the carrier beads, or a coating material may be used which will place a negative charge on the toner particles. It is also contemplated that an arrangement may be desirable in which the carrier bead mixture within the background removal apparatus 18 may include a mixture of carrier beads which are coated with different materials, one material being used which will charge the toner particles positively and another material being used which will charge the toner particles negatively.

While the invention has been described with reference to the structure disclosed, it is not confined to the details set forth, but is intended to cover such modification or changes as may come within the scope of the claims.

What is claimed is:

1. In a reproduction machine having a photoreceptor, means for developing a latent electrostatic image on the photoreceptor to produce a developed image and a background area on the photoreceptor, and means for transferring the developed image from the photoreceptor to a transfer member, background removal apparatus positioned between the developing means and the transferring means for removing toner particles from the background area on the photoreceptor, the background removal apparatus comprising:

(a) transport means for transporting magnetic carrier beads into sweeping contact with toner particles in the background area, and means for electrically biasing the transport means to a polarity and magnitude sufficient to assist in removing the toner particles from the recording surface and onto the carrier beads;

(b) first reclaim means positioned adjacent to the path of the transport means so as to contact the carrier beads having the toner particles thereon, and means for electrically biasing the first reclaim means to a polarity and magnitude sufficient to remove the toner particles from the carrier beads; and (c) means for at least substantially discharging any charge on the carrier beads resulting from contact with the first reclaim means, the discharging means being positioned in the path of the carrier beads so as to contact the carrier beads after the carrier beads contact the first reclaim means but before the carrier beads contact the photoreceptor.

2. The reproduction machine set forth in claim 1, and further including means for grounding the discharging means.

3. The reproduction machine set forth in claim 1, and further including means for electrically biasing the discharging means to a polarity opposite to that of the reclaim means.

4. The reproduction machine set forth in claim 1, and further including second reclaim means positioned adjacent to the path of the transport means so as to contact the carrier beads having the toner particles thereon, and means for electrically biasing the second reclaim means to a polarity opposite to that of the first reclaim means.

5. The reproduction machine set forth in claim 4, wherein the carrier beads includes first and second groups of beads, one of the groups having a different triboelectric property than the second of the group.

6. Apparatus for removing toner particles from a photoreceptor, the apparatus comprising:

(a) transport means for transporting magnetic carrier beads into sweeping contact with the photoreceptor, and means for electrically biasing the transport means to a polarity and magnitude sufficient to assist in removing the toner particles from the photoreceptor and onto the carrier beads;

(b) first reclaim means positioned adjacent to the path of the transport means so as to contact the carrier beads having the toner particles thereon and means for electrically biasing the first reclaim means to a polarity and magnitude sufficient to remove the toner particles from the carrier beads; and (c) means for at least substantially discharging any charge on the carrier beads after the carrier beads contact the first reclaim means but before the carrier beads contact the photoreceptor.

* * * * *